US010138534B2

(12) United States Patent
Hardy et al.

(10) Patent No.: US 10,138,534 B2
(45) Date of Patent: Nov. 27, 2018

(54) NICKEL ALLOY

(71) Applicant: ROLLS-ROYCE PLC, London (GB)

(72) Inventors: Mark C Hardy, Derby (GB); Howard J Stone, Cambridge (GB); Steffen Neumeier, Erlangen (DE); Nicholas G Jones, Cambridge (GB); Katerina Christofidou, Cambridge (GB)

(73) Assignee: ROLLS-ROYCE plc, London (GB)

( * ) Notice: Subject to any disclaimer, the term of this patent is extended or adjusted under 35 U.S.C. 154(b) by 440 days.

(21) Appl. No.: 14/966,564

(22) Filed: Dec. 11, 2015

(65) Prior Publication Data

US 2016/0194736 A1 Jul. 7, 2016

(30) Foreign Application Priority Data

Jan. 7, 2015 (GB) ..... 1500177.9

(51) Int. Cl.
*C22C 19/05* (2006.01)

(52) U.S. Cl.
CPC ..... *C22C 19/056* (2013.01); *C22C 19/05* (2013.01)

(58) Field of Classification Search
CPC ..... C22C 19/056; C22F 1/10
See application file for complete search history.

(56) References Cited

U.S. PATENT DOCUMENTS

| | | | |
|---|---|---|---|
| 2,948,606 | A | 8/1960 | Thielemann |
| 3,459,545 | A | 8/1969 | Bieber et al. |
| 3,677,747 | A | 7/1972 | Lund et al. |
| 4,161,412 | A | 7/1979 | Henry |
| 4,569,824 | A | 2/1986 | Duhl et al. |
| 5,476,555 | A | 12/1995 | Erickson |
| 5,637,159 | A | 6/1997 | Erickson |
| 5,888,316 | A | 3/1999 | Erickson |
| 6,132,527 | A | 10/2000 | Hessell et al. |
| 6,468,368 | B1 | 10/2002 | Merrick et al. |
| 6,969,431 | B2 | 11/2005 | Hieber et al. |
| 6,974,508 | B1 | 12/2005 | Gabb et al. |
| 8,083,872 | B2 | 12/2011 | Mitchell et al. |
| 8,409,722 | B2 | 4/2013 | Torigoe et al. |
| 8,613,810 | B2 | 12/2013 | Mourer et al. |
| 8,734,716 | B2 | 5/2014 | Harada et al. |
| 8,992,699 | B2 | 3/2015 | Bain et al. |
| 2003/0047251 | A1 | 3/2003 | Caron et al. |
| 2004/0221925 | A1 | 11/2004 | Tamaki et al. |
| 2004/0261921 | A1 | 12/2004 | Nazmy |
| 2005/0047954 | A1 | 3/2005 | Hieber et al. |
| 2006/0174482 | A1 | 8/2006 | Roedl et al. |
| 2007/0227630 | A1 | 10/2007 | Augustins Lecallier et al. |
| 2008/0026570 | A1 | 1/2008 | Kim et al. |
| 2008/0101981 | A1 | 5/2008 | Arrell et al. |
| 2010/0008778 | A1 | 1/2010 | Patrick et al. |
| 2010/0080729 | A1 | 4/2010 | Biondo et al. |
| 2010/0303665 | A1 | 12/2010 | Bain et al. |
| 2010/0303666 | A1 | 12/2010 | Bain et al. |
| 2010/0329876 | A1 | 12/2010 | Bain et al. |
| 2011/0194971 | A1 | 8/2011 | Harada et al. |
| 2011/0203707 | A1 | 8/2011 | Mourer et al. |
| 2012/0269646 | A1 | 10/2012 | Mitchell et al. |
| 2012/0273093 | A1 | 11/2012 | Hanlon et al. |
| 2012/0279351 | A1 | 11/2012 | Gu et al. |
| 2013/0167687 | A1 | 7/2013 | Gu et al. |
| 2015/0192022 | A1 | 7/2015 | Bain et al. |

FOREIGN PATENT DOCUMENTS

| | | | |
|---|---|---|---|
| EP | 1193321 | A1 | 4/2002 |
| EP | 1195446 | A1 | 4/2002 |
| EP | 1201777 | A1 | 5/2002 |
| EP | 2045345 | A1 | 4/2009 |
| EP | 2256223 | A1 | 12/2010 |
| EP | 2281907 | A1 | 2/2011 |
| EP | 2407565 | A1 | 1/2012 |
| EP | 2 602 336 | A1 | 6/2013 |
| EP | 3042973 | A1 | 7/2016 |
| GB | 990022 | A | 4/1965 |
| GB | 2152076 | A | 7/1985 |
| JP | 2000063969 | A | 2/2000 |
| SU | 426537 | A1 | 12/1976 |
| WO | 2012/047352 | A2 | 4/2012 |
| WO | 2014/157144 | A1 | 10/2014 |

OTHER PUBLICATIONS

U.S. Appl. No. 15/200,779, filed Jul. 1, 2016 in the name of Mark C. Hardy.
Jul. 1, 2014 Search Report issued in British Patent Application No. GB 1400352.9.
May 22, 2015 Search Report issued in European Patent Application No. 14198811.
Apr. 15, 2016 Search Report issued in British Patent Application No. 1511684.1.
Nov. 17, 2016 Extended Search Report issued in European Patent Application No. 16177287.6.
Jan. 2, 2018 Office Action issued in U.S. Appl. No. 15/200,779.
Jan. 5, 2018 Office Action issued in U.S. Appl. No. 14/577,422.
U.S. Appl. No. 14/577,422, filed Dec. 19, 2014 in the name of Roger Reed et al.
May 20, 2016 Search Report issued in European Patent Application No. 15 19 9133.
Sep. 18, 2015 Search Report issued in British Patent Application No. 1500177.9.
Mignanelli et al., "The influence of Al:Nb ratio on the mircostructure and mechanical response of quaternary Ni—Cr—Al—Nb alloys," Materials Science & Engineering A, vol. 612, 2014, pp. 179-186.
Stephens et al., "Understanding the Roles of the Strategic Element Cobalt in Nickel Base Superalloys," Prepared for the Materials Substitution and Recycling Meeting, Vimerio, Portugal, Oct. 10-14, 1983, NASA Tech. Memo. 83475.
Jun. 19, 2018 Office Action issued in U.S. Appl. No. 15/200,779.

*Primary Examiner* — Jessee R Roe
(74) *Attorney, Agent, or Firm* — Oliff PLC

(57) ABSTRACT

A nickel-base alloy having the following composition (in atomic percent unless otherwise stated): between 12 and 15% of elements from the group consisting of Al, Ti, Ta and Nb, between 12.5% and 17.5% Cr, between 22 and 29% Co, between 0 and 1.5% W, between 0 and 3% Mo, between 0.1 and 0.3% C, between 0.05 and 0.2% B, between 0.02 and 0.07% Zr and, optionally, up to 2% Fe, up to 1% Mn, up to 1% Si, and up to 0.05 Mg; the balance being Ni and incidental impurities. The alloy has an improved combination of properties (principally improved resistance to high temperature deformation and surface environmental damage) compared with known alloys, and is intended to operate for prolonged periods of time above 700° C., and up to peak temperatures of 800° C.

18 Claims, 3 Drawing Sheets

NICKEL ALLOY

This invention relates to nickel base alloys, and particularly, though not exclusively, to alloys suitable for use in the compressor and turbine discs of gas turbine engines. Such discs are critical components of gas turbine engines, and failure of such a component in operation cannot be tolerated.

There is a continuing need for improved alloys to enable disc rotors in gas turbine engines, such as those in the high pressure (HP) compressor and turbine sections, to operate at higher compressor outlet temperatures and faster shaft speeds. In addition, high climb rates are increasingly required by commercial airlines to move aircraft away from the busy air spaces around airports more rapidly, which means that the time the engines must spend at maximum power is significantly increased. These operating conditions give rise to fatigue cycles with long dwell periods at elevated temperatures in which oxidation and time dependent deformation significantly influence the resistance to low cycle fatigue. As a result, there is a need to improve the resistance of alloys to surface environmental damage and dwell fatigue crack growth, and to increase proof strength, without compromising their other mechanical and physical properties or increasing their density.

Some known nickel base alloys have compromised resistance to surface environmental degradation (oxidation and Type II hot corrosion) in order to achieve improved high temperature strength, resistance to creep strain accumulation and achieve stable bulk material microstructures (to prevent the precipitation of detrimental topologically close-packed (TCP) phases such as the σ or μ phases. Currently, HP disc rotors are commonly exposed to temperatures above 650° C. and in future engine designs will be exposed to temperatures above 700° C., or perhaps as high as 800° C. As disc temperatures continue to increase, oxidation and hot corrosion may limit disc life as this environmental damage can nucleate fatigue cracks. Therefore, there is a need in the design of future disc alloys to prioritise high temperature properties.

Known alloys cannot provide the balance of properties needed for such operating conditions. In particular, the present state of the art is unable to provide; sufficient resistance to fatigue cycles with dwells at temperatures in the range of 600° C. to 800° C., resistance to environmental damage, microstructural stability and high levels of proof strength. As such, they are not viable candidates for disc applications at peak temperatures of 750° C. to 800° C., because component lives would be unacceptably low.

The following publications describe prior Ni alloy compositions: US 2008/026570, U.S. Pat. Nos. 5,476,555, 5,888,316, 8,613,810, US2010303666, US2010303665, EP1195446 and EP2045345.

However, these compositions may not have the desired combination of properties for future disc alloys.

STATEMENT OF INVENTION

According to a first aspect of the present invention, there is provided a nickel-alloy having the following composition (in atomic percent unless otherwise stated): a total of between 12 and 15% of elements from the group consisting of Al, Ti, Ta and Nb, between 12.5% and 17.5% Cr, between 22 and 29% Co, between 0.1 and 0.3% C, between 0.05 and 0.2% B, between 0.02 and 0.07% Zr, up to 1.5% W, up to 3% Mo, up to 2% Fe, up to 1% Mn, up to 1% Si, up to 0.15% Hf, and up to 0.05% Mg; the balance being Ni and incidental impurities.

It has been found that an alloy having the above composition provides superior high temperature material properties in comparison to prior compositions and can operate for prolonged periods of time at temperatures above 700° C., without showing unacceptably high levels of environmental damage or precipitating harmful TCP phases.

According to a second aspect of the present invention, there is provided a gas turbine engine component comprising an alloy in accordance with the first aspect of the invention.

Further aspects of the invention are provided in the attached claims.

DETAILED DESCRIPTION

Figure 1:
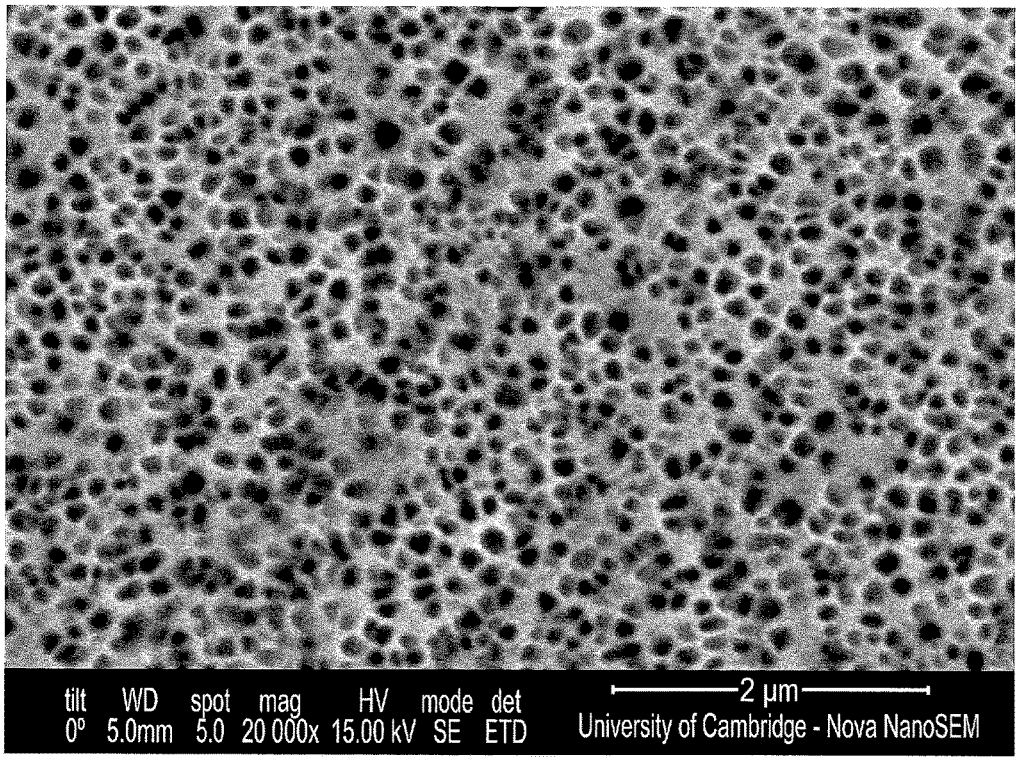
FIG. 1 is a secondary electron microscope image of an alloy in accordance with the present invention.

It is an aim of the invention to provide a nickel base alloy that can operate for prolonged periods of time above 700° C., and up to peak temperatures of 800° C.

The invention provides a nickel base alloy as set out in the claims.

The invention will be more fully described, by way of example only, with reference to the accompanying drawings.

Nickel based superalloys comprising a face-centred cubic γ matrix reinforced by a fine dispersion of precipitates that have a superlattice structure of the matrix, either gamma prime (γ') or gamma double prime (γ"), are widely used in high temperature structural applications. Such applications include, but are not limited to, components (such as disc rotors) in the high pressure (HP) compressor and turbine within gas turbine aero-engines. It is understood that the properties of such alloys are strongly related to their compositions and microstructures. The HP disc rotors used in gas turbine aero-engines are often manufactured from polycrystalline nickel-based superalloys. The range of conditions experienced by such components in service demands that such alloys show high yield and fracture stress and exhibit strong resistance to fatigue, particularly those with prolonged dwell periods at high temperatures, creep resistance and environmental resistance, particularly due to hot corrosion.

The present disclosure relates to a nickel-based superalloy that maintains mechanical strength to 800° C. whilst retaining adequate environmental resistance and microstructural stability. The desired mechanical strength of this superalloy is derived at least in part from elevated additions of Co and Ti, as compared to conventional alloys, which provide strengthening of both the γ matrix and the γ' precipitates. Additional solid solution strenghtening of the γ matrix is achieved by additions of Mo and W. The environmental resistance of the alloy has been achieved by optimising the Cr content in the matrix to enable the formation of a protective chromia ($Cr_2O_3$) scale. Critically, to meet these requirements whilst simultaneously ensuring that the alloy has acceptable stability against the formation of undesirable TCP phases, Mo and W have been tailored to concentrations up to a maximum level of 3 at. % and 1.5 at. % respectively. It has been found that oxidation resistance can be improved in these alloys with a Ti:Ta atomic ratio greater than 2:1.

The inventors have determined that alloys with compositions within the following ranges will provide the required balance of high temperature proof strength, resistance to fatigue crack nucleation and propagation, creep strain accumulation, and oxidation/hot corrosion damage.

In general, compositions in accordance with the present invention comprise elements in the following amounts in atomic percent (Table 1).

TABLE 1

| at. % | Lower Limit (at. %) | Upper Limit (at. %) |
|---|---|---|
| Ni | Bal. | Bal. |
| Co | 22 | 29 |
| Cr | 12.5 | 17.5 |
| Fe | 0 | 2 |
| Al | 5 | 7.5 |
| Ti | 2.5 | 6 |
| Ta | 0 | 2.5 |
| Nb | 0 | 2 |
| Mo | 0 | 3 |
| W | 0 | 1.5 |
| Mn | 0 | 1 |
| Si | 0 | 1 |
| Hf | 0 | 0.15 |
| C | 0.1 | 0.3 |

TABLE 1-continued

| at. % | Lower Limit (at. %) | Upper Limit (at. %) |
|---|---|---|
| B | 0.05 | 0.2 |
| Zr | 0.02 | 0.07 |
| Mg | 0 | 0.05 |

Preferred composition specifications are given in both atomic percent in table 2.

TABLE 2

| at. % | Lower Limit (at. %) | Upper Limit (at. %) |
|---|---|---|
| Ni | Bal. | Bal. |
| Co | 22 | 27 |
| Cr | 13.5 | 16 |
| Fe | 0 | 1 |
| Al | 5.75 | 6.75 |
| Ti | 4.5 | 5.8 |
| Ta | 0.5 | 1.3 |
| Nb | 0 | 1 |
| Mo | 1.4 | 2.85 |
| W | 0 | 1.1 |
| Mn | 0 | 0.7 |
| Si | 0 | 1 |
| Hf | 0 | 0.15 |
| C | 0.1 | 0.3 |
| B | 0.05 | 0.2 |
| Zr | 0.02 | 0.07 |
| Mg | 0 | 0.05 |

Thirteen example alloys have been produced; details of their compositions are listed in table 3(i) by atomic percent, and in table 3(ii) by weight percent.

TABLE 3(i)

| at. % | Co | Ni | Cr | Ti | Al | Ta | Nb | Mo | W | B | C | Zr |
|---|---|---|---|---|---|---|---|---|---|---|---|---|
| V202F | 26 | 43.77 | 15.5 | 3.6 | 6.40 | 2.40 | 0 | 1.50 | 0.5 | 0.150 | 0.150 | 0.030 |
| V202G | 26 | 43.77 | 15.5 | 4.2 | 6.40 | 1.80 | 0 | 1.50 | 0.5 | 0.150 | 0.150 | 0.030 |
| V202H | 26 | 43.77 | 15.5 | 5.4 | 6.40 | 0.60 | 0 | 1.50 | 0.5 | 0.150 | 0.150 | 0.030 |
| V202KHN base | 23 | 47.4 | 15.1 | 4.8 | 6.25 | 1.20 | 0 | 1.50 | 0.5 | 0.150 | 0.135 | 0.050 |
| V202KHN1 | 23 | 46.60 | 15.1 | 4.8 | 6.25 | 1.20 | 0 | 2.25 | 0.5 | 0.150 | 0.135 | 0.050 |
| V202KHN2 | 23 | 47.00 | 151 | 4.8 | 6.25 | 1.20 | 0 | 1.80 | 0.5 | 0.150 | 0.135 | 0.050 |
| V202KHN3 | 23 | 46.60 | 15.1 | 4.8 | 6.25 | 1.20 | 0 | 2.75 | 0 | 0.150 | 0.135 | 0.050 |
| V202KHN4 | 26 | 44.30 | 15.1 | 4.8 | 6.25 | 1.20 | 0 | 1.50 | 0.5 | 0.150 | 0.135 | 0.050 |
| V202KHN5 | 23 | 47.10 | 15.1 | 4.8 | 6.25 | 1.20 | 0.25 | 1.50 | 0.5 | 0.150 | 0.135 | 0.050 |
| V202H1 | 26 | 43.40 | 15.0 | 5.5 | 6.25 | 0.75 | 0.25 | 1.50 | 1.00 | 0.135 | 0.145 | 0.035 |
| V202H3 | 26 | 42.90 | 15.0 | 5.5 | 6.25 | 0.75 | 0.25 | 2.00 | 1.00 | 0.135 | 0.145 | 0.035 |
| V202X' | 23 | 49.57 | 13 | 2.75 | 7.25 | 1 | 2 | 0.1 | 1.00 | 0.150 | 0.150 | 0.035 |
| V202W | 27 | 45.67 | 13.5 | 5 | 6.5 | 1 | 0 | 0.25 | 0.75 | 0.150 | 0.150 | 0.035 |

TABLE 3(ii)

| wt % | Co | Ni | Cr | Ti | Al | Ta | Nb | Mo | W | B | C | Zr |
|---|---|---|---|---|---|---|---|---|---|---|---|---|
| V202F | 25.85 | 43.33 | 13.59 | 2.91 | 2.91 | 7.33 | 0 | 2.43 | 1.55 | 0.027 | 0.030 | 0.046 |
| V202G | 26.20 | 43.92 | 13.78 | 3.44 | 2.95 | 5.57 | 0 | 2.46 | 1.57 | 0.028 | 0.031 | 0.047 |
| V202H | 26.93 | 45.16 | 14.17 | 4.54 | 3.04 | 1.91 | 0 | 2.53 | 1.62 | 0.029 | 0.032 | 0.048 |
| V202KHN base | 23.46 | 48.07 | 13.59 | 3.98 | 2.92 | 3.76 | 0 | 2.49 | 1.59 | 0.028 | 0.028 | 0.079 |
| V202KHN1 | 23.53 | 47.08 | 13.53 | 3.96 | 2.91 | 3.74 | 0 | 3.72 | 1.58 | 0.028 | 0.028 | 0.079 |
| V202KHN2 | 23.42 | 47.68 | 13.56 | 3.97 | 2.91 | 3.75 | 0 | 2.98 | 1.59 | 0.028 | 0.028 | 0.079 |
| V202KHN3 | 23.53 | 47.44 | 13.63 | 3.99 | 2.93 | 3.77 | 0 | 4.58 | 0 | 0.028 | 0.028 | 0.079 |
| V202KHN4 | 26.52 | 45.02 | 13.59 | 3.98 | 2.92 | 3.76 | 0 | 2.49 | 1.59 | 0.028 | 0.028 | 0.079 |
| V202KHN5 | 23.43 | 47.75 | 13.57 | 3.97 | 2.91 | 3.75 | 0.40 | 2.49 | 1.59 | 0.028 | 0.028 | 0.079 |
| V202H1 | 26.48 | 44.06 | 13.48 | 4.55 | 2.91 | 2.35 | 0.40 | 2.49 | 3.18 | 0.025 | 0.030 | 0.055 |
| V202H3 | 26.39 | 43.41 | 13.44 | 4.54 | 2.90 | 2.34 | 0.40 | 3.31 | 3.17 | 0.025 | 0.030 | 0.055 |
| V202X' | 23.23 | 49.86 | 11.59 | 2.26 | 3.35 | 3.10 | 3.18 | 0.16 | 3.15 | 0.028 | 0.031 | 0.055 |
| V202W | 27.73 | 46.71 | 12.23 | 4.17 | 3.06 | 3.15 | 0 | 0.42 | 2.40 | 0.028 | 0.031 | 0.056 |

Experimental quantities of alloys V202F, V202G, V202H, V202X' and V202W have been produced by a conventional powder processing route. All other alloys were cast using vacuum arc melting from raw elements and binary master alloys. Microstructural characterisation of all of the alloys produced has been performed. A secondary electron image showing the γ/γ' microstructure from alloy cast V202H3, after homogenization at 1200° C. for 2 hours and ageing at 850° C. for 4 hours is given in FIG. 1. The image shows that the alloy exhibits the desired γ/γ' microstructure.

Alloys of the present invention have been designed to produce a microstructure that initially comprises of a disordered face centred cubic (Al in Strukturbericht notation) γ matrix with ordered, γ' precipitates ($L1_2$).

The disclosed alloy compositions have been chosen to maintain high strength levels to temperatures up to 800° C. This has been achieved in part through; precipitate strengthening with a high volume fraction (~50% at 800° C.) of small γ' precipitates (i.e. $(Ni,Co)_3(Al,Ti,Ta,Nb)$); by strengthening both the matrix and the precipitates through comparatively high concentrations of Co and Ti; and, by solid solution strengthening of the γ matrix using one or more of Co, Mo, W and Cr. All of these strengthening mechanisms are deemed necessary in order to achieve the desired strength at elevated temperatures. The strength of γ' reinforced superalloys is known to scale with the precipitate volume fraction. Elevated levels of Ti are known to provide significant strengthening in superalloys through increased anti phase boundary (APB) energies, thereby inhibiting dislocation motion through the γ' precipitates. However, simply elevating the level of Ti in the alloy has been found by the inventors to lead to the formation of η, which is considered undesirable in the present invention. This issue is overcome by simultaneous co-additions of Ti and Co that serve to preserve the γ/γ' microstructure. Through these combined strengthening mechanisms, the compositions described in the present disclosure are able to produce high strength levels from a relatively coarse grained (30-45 μm) microstructure, which is required to optimise the resistance to intergranular dwell crack growth.

Figure 2A:
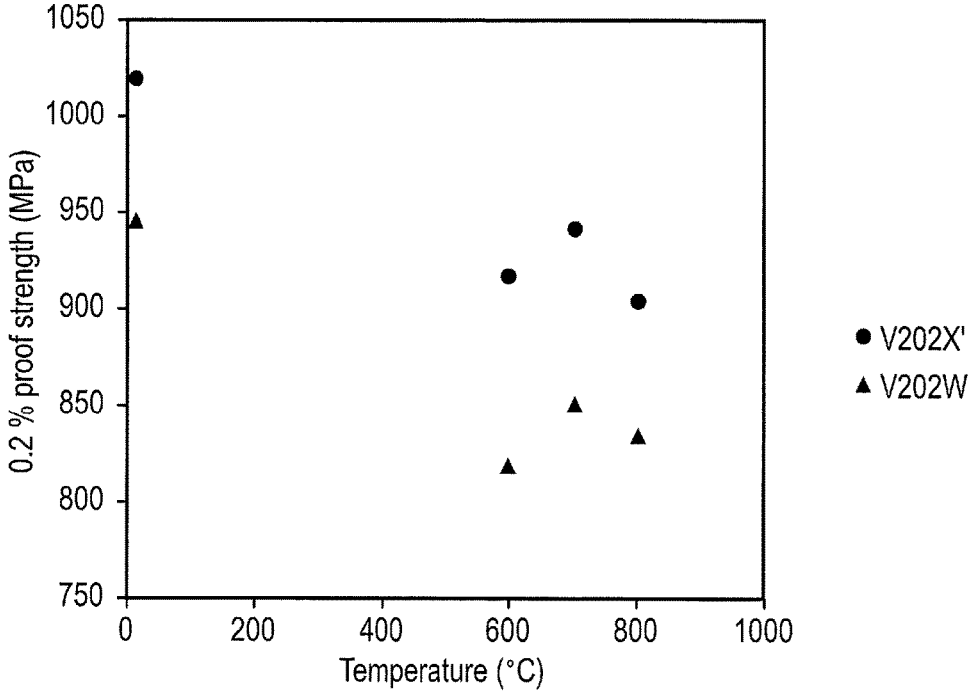
FIGS. 2*a* and 2*b* are graphs showing the 0.2% proof strength and ultimate tensile strength respectively of powder processed alloys in accordance with the present invention.
Figure 2B:
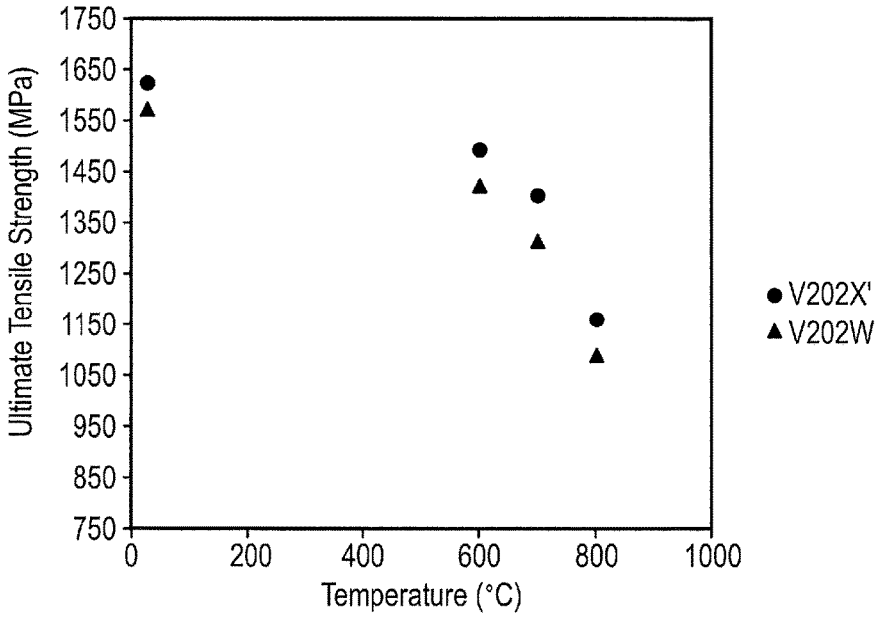
Figure 3:
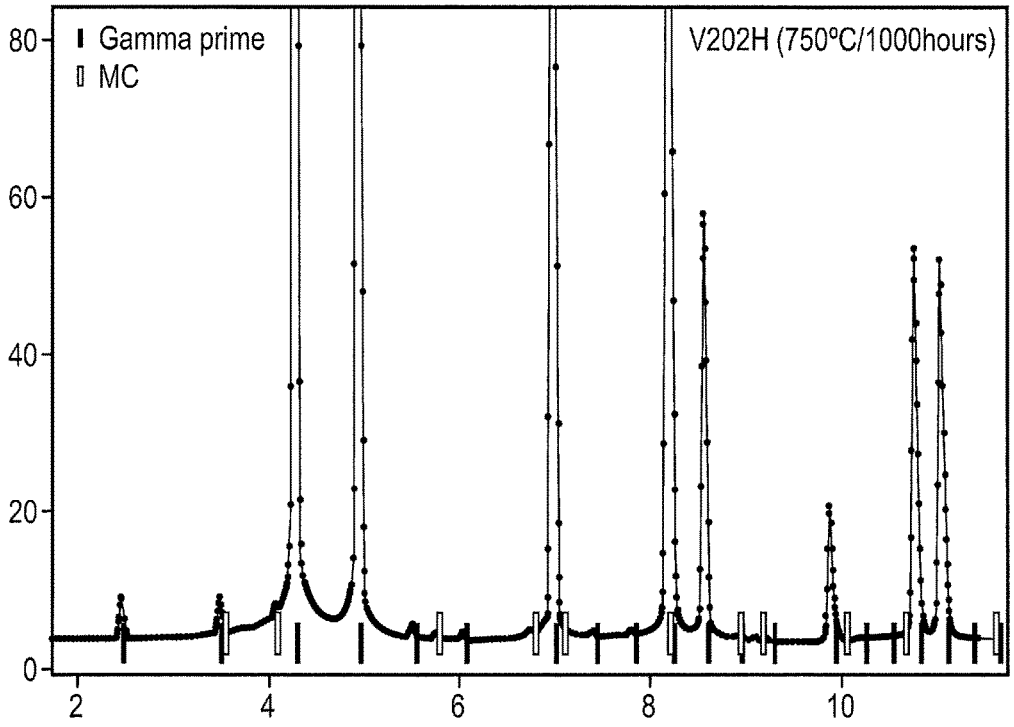
FIG. 3 is a high resolution synchrotron X-ray diffraction patterns of an alloy in accordance with the present invention after exposure at 750° C. for 1000 hours.

FIG. 2 shows the 0.2% proof and tensile strength data for powder processed alloys V202X' and V202W. Both alloys show proof strength at high temperatures of at least 800 MPa, which is deemed sufficiently high for the applications for which the alloys were designed. High resolution synchrotron X-ray diffraction of alloy V202H, after exposure to 750° C. for 1000 hours, revealed diffraction patterns free of peaks associated with unwanted phases, such as σ or $M_{23}C_6$ carbides (see FIG. 3). Microstructural characterisation of the alloy also confirmed this result. All other alloys provided as examples of the present invention show no evidence of unwanted precipitation after microstructural examination of material exposed to 800° C. for 100 hours.

Operation at elevated temperatures requires these alloys to form protective oxide scales. At the intended service temperatures, the current invention has been designed to achieve this through the formation of chromium (III) oxide. However, Cr additions are also known to aggravate the precipitation of TCP phases, especially in the presence of Mo and W, and so the disclosed compositions have been tailored to optimise both environmental resistance and microstructural stability.

Figure 4A:
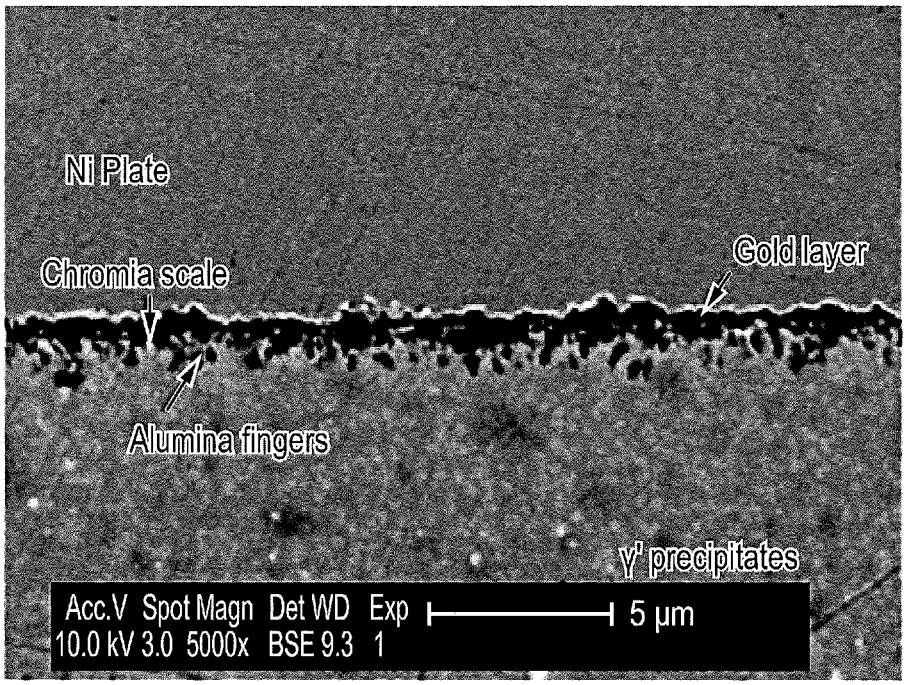
FIGS. 4*a* and 4*b* are scanning electron micrograph images of oxidation scale on an alloy in accordance with the present invention and the prior art alloy RR1000 respectively after characterisation using isothermal exposure at 800° C. for 100 hours.
Figure 4B:
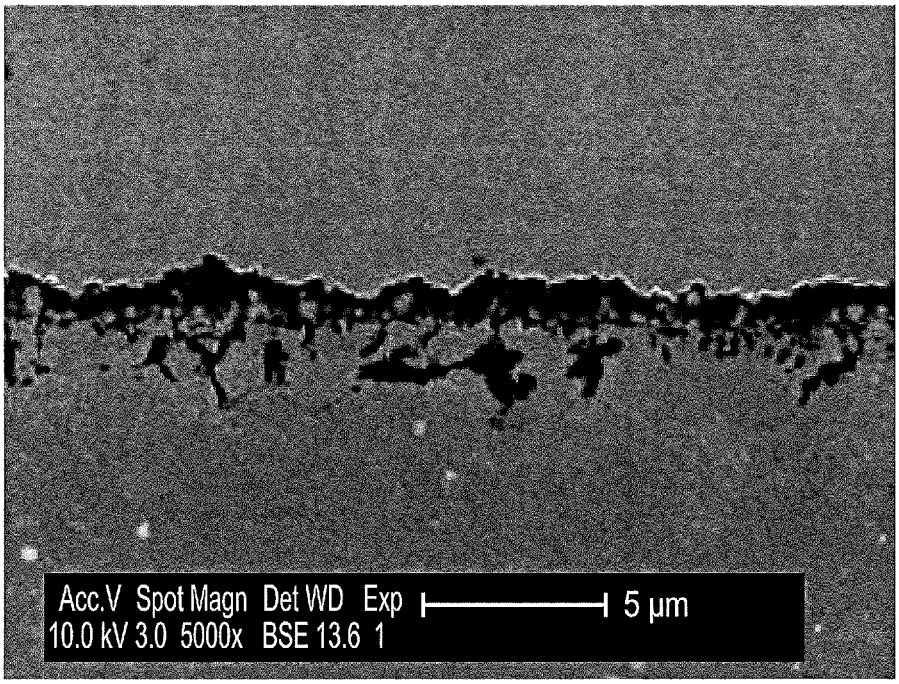

FIGS. 4*a* and 4*b* show the oxidation scale and penetration depth obtained from alloys V202H (FIG. 4*a*) and RR1000 (FIG. 4*b*) after exposure to 800° C. for 100 hours. The relative thickness of the oxide scale and the depth of the penetration damage of the two alloys, suggest that alloy V202H, of the present invention, is significantly more resistant to environmental degradation than RR1000.

It is thought in particular that the Ti:Ta atomic ratio of the present alloys is at least in part responsible for the observed improved oxidation resistance. In contrast, alloy RR1000 has a thicker thicker oxide scale and subscale damage zone compared to V202H. This result is surprising, since previous research has indicated that nickel disc alloys having relatively high Ti content and low Cr:Ti ratio (in atomic %) would have worse oxidation resistance.

As with prior superalloys, the volume fraction of γ' precipitates decrease as temperature increases, giving rise to a concomitant reduction in alloy strength. To ensure sufficient mechanical strength is retained, a target volume fraction of γ' of ~48% is desired at 800° C. To achieve this, in excess of 12 at. % of the γ' forming elements (Al+Ti+Ta+Nb) are required. Of these elements, Al should preferably be included in the range of 5-7.5 at. %, Ti preferably in the range of 2.5-6 at. %, Ta preferably in the range of 0 to 2.5 at. % and preferably Nb in the range of 0 to 2 at. %. It will however be understood that the relative amounts of these γ' forming elements can be varied to obtain desired properties (for example in terms of alloy weight and cost), provided the total of Al+Ti+Ta+Nb is between 12 and 15 at %.

The concentrations of alloying elements have been selected within the described ranges for the reasons detailed below.

Aluminium promotes the formation of the γ' phase. It also serves to reduce the overall density of the alloys thereby improving specific (density-corrected) properties and assist in controlling the lattice misfit between the γ matrix and the γ' precipitates. However, higher aluminium contents are associated with increased γ' solvus temperatures, which may compromise the thermo-mechanical processing characteristics of the alloy. In addition, as aluminium increasingly partitions to the γ phase at temperatures above 600° C., high concentrations may be associated with an increased propensity for the formation of the sigma (σ) phase at grain boundaries, which is considered highly detrimental to alloy performance.

Titanium is known to confer significant strengthening to the γ' phase through solid solution strengthening and by increasing the anti-phase boundary (APB) energy. It is believed that a Ti concentration of greater than 4.0 at. % is desirable to achieve an appropriate level of strengthening, although benefits may also be derived from lower additions from alloys with increased concentrations of other γ' forming elements. Importantly, the concentration of Ti has to be controlled so that precipitation of the η ($Ni_3Ti$) phase can be avoided, which is considered undesirable in the present invention. In addition, care must also be taken not to destabilise the MC carbide (where M may be either or a mixture of Ta, Ti or Nb) with respect to $M_{23}C_6$ (where M is Cr and Mo) as the presence of some intergranular MC carbide is believed to be more desirable for grain boundary strengthening and the $M_{23}C_6$ is understood to be the precursor for the precipitation of the TCP σ phase.

Tantalum additions, like titanium additions, provide benefits to the alloy by contributing to the strength of the γ' through increasing the APB energy and stabilising the MC carbides. However, the concentration of tantalum needs to be limited, as it is also known to participate in the formation of the unwanted η phase. Furthermore, lower concentrations of Ta minimise the increase in alloy density and minimise the cost of the alloy. The tantalum content of the alloys of this invention therefore preferably lies in the range of 0<Ta at. %<2.5, and more preferably in the range 0<Ta at. %<1.3.

Niobium additions have been shown to be effective in refining the size of the γ' particles [Mignanelli, N. G. Jones, M. C. Hardy, and H. J. Stone, "The influence of Al:Nb ratio on the microstructure and mechanical response of quaternary Ni—Cr—Al—Nb alloys," *Mater. Sci. Eng. A*, vol. 612, pp. 179-186, Aug. 2014.]. This is associated with a commensurate increase in strength. However, it has been found that the effect of Nb on dwell crack growth behavior of nickel disc alloys can vary significantly. Results obtained from cast & wrought alloys, such as Inconel 718, suggest that Nb is detrimental to dwell crack growth as a result of the oxidation of both the large blocky MC carbides and the $Ni_3Nb$ (δ) phase, which reside on grain boundaries and form brittle $Nb_2O_5$. It is also known that a small fraction of Nb partitions to the γ phase and may segregate to grain boundaries ahead of a growing crack. The formation of $Nb_2O_5$ is particularly detrimental as it produces a large volume change, indicated by its high Piling-Bedworth ratio, leading to high stresses and an adverse effect on the environmental resistance of the alloy. As a result of these constraints, the niobium content of the alloys of this invention preferably lies in the range 0<Nb at. %<2.0.

Molybdenum is widely included in significant quantities in alloys of the prior art, typically in the range 2<Mo wt. %<10 and more commonly in the range 3<Mo wt. %<5 (see for example Mitchell and Hardy, EP2045345). This element is known to preferentially partition to the γ phase, acting as a potent solid solution strengthener, increasing the lattice parameter of this phase and thereby also reducing the lattice misfit. However, this element has also been found by the inventors to strongly promote the formation of the σ phase, which is considered deleterious for the mechanical and environmental integrity of the alloys. In the present disclosure, the molybdenum content has been controlled to permit sufficient chromium additions to provide suitable oxidation resistance, without compromising the stability of the alloy with respect to the σ phase. Molybdenum concentration in the range of 0<Mo at. %<3 may optionally be added to the alloys of the present invention in line with the considerations mentioned above and to provide solid solution strengthening of the γ phase. In general, the total of Mo and W is preferably maintained below 3 at. %, and preferably between 2 and 3 at. %.

Tungsten additions offer solid solution strengthening of both the γ and γ' phases and may be used to partially compensate for reduced molybdenum levels in the γ phase. However, with tungsten additions in excess of 1.5 at. %, produce an adverse effect on the overall density of the alloy and alloy stability becomes compromised with respect to the formation of the μ phase. The compositions of alloys of the present invention are therefore limited to the range 0<W at. %<1.5.

The chromium concentration range specified in the present invention of 12.5<Cr at. %<17.5, has been chosen to ensure that suitable environmental resistance is achieved without unduly compromising the stability of the alloy towards the formation of undesirable TCP phases. Chromium also offers limited solid solution strengthening of the γ phase. Surprisingly, it has been found that the oxidation resistance of these alloys is good, in spite of relatively high levels of Ti, and relatively low levels of Cr. This is in contrast to suggestions in the published literature, which suggest that such Ti and Cr levels would result in relatively poor oxidation resistance.

The alloys of the present invention all contain higher cobalt concentrations than most of the prior art. Generally, elevated cobalt concentrations in nickel-based superalloys have been found to be effective in lowering the stacking fault energy (SFE) of the γ phase. This allows the partial dislocations that control plastic deformation in this phase to become more widely separated, thereby restricting cross slip of dislocations and offering improved strength, creep and fatigue properties. In addition, the minimum creep rate of nickel-based alloys has been shown to scale with SFE. Lower SFE increases the propensity to form annealing twins in alloys that show a grain size above 20 μm. The presence of annealing twins reduces the effective grain size. As cracks develop along persistent slip bands (PSBs) that run across the grain, reducing the size of grains reduces the length of PSBs and improves crack nucleation life. As annealing twins are special boundaries, their presence also reduces diffusion of aggressive species such as oxygen, improving resistance to intergranular dwell crack growth. In addition, evidence also exists to show that cobalt stabilises the MC carbides required for grain boundary strengthening [Stephens and R. L. Dreshfield, "Understanding the roles of the strategic element cobalt in nickel base superalloys," NASA report 1983.]. It is also understood that cobalt is beneficial in terms of limiting the coarsening of secondary γ' particles during moderately slow cooling rates, which are required to produce serrated grain boundaries, and in preventing these significantly deviating from a spherical morphology. In alloys of the present invention, cobalt has been limited to below 29 at. %, as this is believed by the inventors to be the limit to which the balance of properties required for the intended application are obtained.

Iron may be tolerated in the alloys of the present invention up to 2 at. % without excessively compromising the properties. This reduces alloy cost by allowing revert (solid scrap and machining chips) material to be included in alloy manufacture.

Prior research has suggested that additions of manganese or silicon may modify the oxidation and hot corrosion resistance of superalloys. However, it is recognised that silicon additions reduces the solidus and γ' solvus temperature and promote the formation of σ phase, which requires that the chromium content in the alloy be reduced to maintain a stable microstructure. This potentially limits any benefit that may be derived from adding silicon. Manganese, at levels of 0 to 1 at. %, has been previously shown (see U.S. Pat. No. 4,569,824) to improve both the corrosion resistance of polycrystalline nickel alloys at temperatures between 650-760° C. as well as the creep properties. The benefits of Mn, like those of Zr and Mg, are understood to result from precipitation of sulphides that have a higher melting temperature than low melting point nickel sulphides ($Ni_3S_2$), which reduce the cohesive strength of grain boundaries and give rise to embrittlement and intergranular cracking, particularly at high temperatures.

In the alloys of the present invention, a carbon concentration between 0.1 and 0.3 at. % has been specified. It has previously been shown that 0.03 wt. % carbon minimises internal oxidation damage from decomposition of $M_{23}C_6$ carbides. However, more effective control grain growth through grain boundary pinning during super-solvus solution heat treatments is achieved with carbon concentration of 0.05 wt. %. It is understood that higher carbon concentrations produce; smaller average grain sizes; narrower grain size distributions; and, lower As Large As (ALA) grain sizes. This is significant as yield stress, tensile strength and fatigue endurance at intermediate temperatures (<650° C.) are highly sensitive to grain size.

It is understood that appropriate additions of zirconium (in the region of 0.02 to 0.07 at. %) and boron (in the region of 0.05-0.2 at. %) are required to optimise the resistance to intergranular crack growth from high temperature dwell fatigue cycles.

In the development of both cast and forged polycrystalline superalloys for gas turbine applications, zirconium is known to improve high temperature tensile ductility, strength and creep resistance. Zirconium also scavenges oxygen and sulphur at grain boundaries, forming small zirconium oxide or sulphide particles. This provides improved grain boundary cohesion and potential barriers to grain boundary diffusion of oxygen. Zirconium also contributes to stable MC carbides.

The role of boron is less clear. It is known that boron promotes the precipitation of $M_3B_2$ boride particles on the grain boundaries that are believed to be beneficial to dwell crack growth resistance. The concentration of boron should be at a level that ensures that there are sufficient particles on the grain boundaries to minimise grain boundary sliding during dwell fatigue cycles as well as providing barriers to stress assisted diffusion of oxygen. It is also understood that elemental boron improves grain boundary cohesion. However, boron can be detrimental if added in sufficient quantities as it locally reduces the incipient melting temperature so that continuous grain boundary films can form during super-solvus heat treatment.

Hafnium is a potent MC carbide forming element. However, as with zirconium, hafnium also serves to scavenge oxygen and sulphur. If hafnium concentrations in excess of 0.4 wt. %, were to be incorporated into the γ', this would increase the γ' solvus temperature and improve strength and resistance to creep strain accumulation. However, hafnium's affinity for oxygen is such that hafnium oxide particles/inclusions may be produced during melt processing of the alloy. These melt anomalies need to be managed, and the issues associated with their occurrence must be balanced against the likely benefits. Hence, preferably, no hafnium is desired in alloys of the present invention. However, a small amount of Hf may be permitted.

The concentrations of incidental impurities such as the trace elements sulphur and phosphorous should be minimised to promote good grain boundary strength and maintain the mechanical integrity of oxide scales. It is understood that levels of sulphur and phosphorous less than 5 and 20 ppm respectively are achievable in large production size batches of material. However, it is anticipated that the benefits of the invention would still be achieved, provided the level of sulphur is less than 20 ppm and phosphorous less than 60 ppm. Although, in these circumstances, it is likely that the resistance to oxide cracking may be reduced.

It is envisaged that alloys according to the present invention will preferably be produced using powder metallurgy, such that small powder particles (<53 μm diameter) produced by inert gas atomisation will be consolidated in a stainless steel container using hot isostatic pressing or hot compaction and then extruded or hot worked to produce fine grain size billet. Indeed, sections taken from these billets may be forged under isothermal conditions. Appropriate forging temperatures, strains and strain rates would be used to achieve the desired average grain size of ASTM 8 to 7 (22-32 μm) following solution heat treatment above the γ' solvus temperature.

To achieve the required balance of properties in the alloys of the present invention, careful heat treatment is desirable. The preferred heat treatment steps are described below:

1. Solution heat treat the forging above the γ' solvus temperature for sufficient time to increase the grain size to ASTM 8 to 7 (22-32 μm). Appropriate forging conditions and levels of deformation will be used to control grain growth, particularly to prevent isolated grains from growing to sizes greater than ASTM 2 (180 μm).
2. Quench the forging from the solution heat treatment temperatures to room temperature using forced or fan air-cooling. The resistance to dwell crack growth is optimised if the cooling rate from solution heat treatment is controlled so as to produce grain boundary serrations around secondary γ' particles. Such serrations improve the resistance to grain boundary sliding and increase oxygen diffusion distances.
3. Perform a stabilisation, precipitation and stress relief heat treatment at a temperature between 800° C. and 900° C. for 1-16 hours, then air cool. This heat treatment is required to relieve residual stresses from quenching, and coarsen the γ' precipitates.
4. Conduct a dual microstructure solution heat treatment (U.S. Pat. No. 8,083,872). This processing step may be performed if higher levels of yield stress, tensile strength and low cycle fatigue performance are required in the bore and diaphragm regions at temperatures below 650° C.

The compositions of the present invention provide alloys suitable for disc rotor applications. Components manufactured from these alloys will have a balance of material properties that will allow them to be used at significantly higher temperatures than those currently used.

In contrast to the prior art, alloys of the present invention offer a superior balance between resistance to environmental degradation, high temperature mechanical properties and microstructural stability. This enables alloys of the present invention to be used for components operating at temperatures up to 800° C., in contrast to existing alloys that are limited to temperatures of 700-750° C.

Although the alloys of the present invention are particularly suitable for disc rotor applications in gas turbine engines, it will be appreciated that they may also be used in other applications. Within the field of gas turbines, for example, they will be well suited for use in combustor or turbine casings. In addition, as new, more efficient engines are designed, the temperatures in the engine core are expected to rise. Therefore, alloys with higher temperature capability may well be suitable for use in other engine components. The alloy could be formed using different routes, such as conventional ingot metallurgy, rather than powder metallurgy. The atomic percentages of the example alloys are target percentages. A range of elemental values is specified for a composition to be produced in practice in large volume as losses and variation can occur during melting. Consequently, the examples given in the tables are nominal compositional targets. The alloy may consist essentially of the elements listed in table 1, in addition to incidental impurities such as O, N, S and P. Additionally, small amount (such as up to 0.05 at. % Mg) could be added without detrimentally affecting the material properties of the alloy.

The invention claimed is:

1. A nickel alloy having the following composition (in atomic percent unless otherwise stated): between 5.75 and 6.75 Al, between 4.5 and 5.8 Ti, between 0.5 and 1.3 Ta, up to 1% Nb, between 13.5% and 16% Cr, between 22and 27% Co, between 0.1 and 0.3% C, between 0.05 and 0.2% B, between 0.02 and 0.07% Zr, up to 1.1% W, between 1.4 and 2.85% Mo, up to 1% Fe, up to 0.7% Mn, up to 1% Si, up to 0.15% Hf, and up to 0.05% Mg; the balance being Ni and incidental impurities.

2. A nickel-base alloy as claimed claim 1 and having the following composition: 26% Co, 15.5% Cr, 5.4% Ti, 6.4% Al, 0.6% Ta, 1.5% Mo, 0.5% W, 0.15% B, 0.15% C and 0.03% Zr; the balance being Ni and incidental impurities.

3. A nickel-base alloy as claimed in claim 1 and having the following composition: 23% Co, 15.1% Cr, 4.8% Ti, 6.25% Al, 1.20% Ta, 1.5% Mo, 0.5% W, 0.15% B, 0.135% C and 0.05% Zr; the balance being Ni and incidental impurities.

4. A nickel-base alloy as claimed in claim 1 and having the following composition: 23% Co, 15.1% Cr, 4.8% Ti, 6.25% Al, 1.20% Ta, 0% Nb, 2.25% Mo, 0.5% W, 0.15% B, 0.135% C and 0.05% Zr; the balance being Ni and incidental impurities.

5. A nickel-base alloy as claimed in claim 1 and having the following composition: 23% Co, 15.1% Cr, 4.8% Ti, 6.25% Al, 1.20% Ta, 1.8% Mo, 0.5% W, 0.15% B, 0.135% C and 0.05% Zr; the balance being Ni and incidental impurities.

6. A nickel-base alloy as claimed in claim 1 and having the following composition: 23% Co, 15.1% Cr, 4.8% Ti, 6.25% Al, 1.20% Ta, 2.75% Mo, 0.15% B, 0.135% C and 0.05% Zr; the balance being Ni and incidental impurities.

7. A nickel-base alloy as claimed in claim 1 and having the following composition: 26% Co, 15.1% Cr, 4.8% Ti, 6.25% Al, 1.20% Ta, 1.5% Mo, 0.5% W, 0.15% B, 0.135% C and 0.05% Zr; the balance being Ni and incidental impurities.

8. A nickel-base alloy as claimed in claim 1 and having the following composition: 23% Co, 15.1% Cr, 4.8% Ti, 6.25% Al, 1.20% Ta, 0.25% Nb, 1.5% Mo, 0.5% W, 0.15% B, 0.135% C and 0.05% Zr; the balance being Ni and incidental impurities.

9. A nickel-base alloy as claimed in claim 1 and having the following composition: 26% Co, 15% Cr, 5.5% Ti, 6.25% Al, 0.75% Ta, 0.25% Nb, 1.50% Mo, 1% W, 0.135% B, 0.145C and 0.035Zr; the balance being Ni and incidental impurities.

10. A nickel-base alloy as claimed in claim 1 and having the following composition: 26% Co, 15% Cr, 5.5% Ti, 6.25% Al, 0.75% Ta, 0.25% Nb, 2% Mo, 1% W, 0.135% B, 0.145% C and 0.035% Zr; the balance being Ni and incidental impurities.

11. A nickel-base alloy as claimed in claim 1, in which the S content is less than 20 ppm.

12. A nickel-base alloy as claimed in claim 1, in which the S content is less than 5 ppm.

13. A nickel-base alloy as claimed in claim 1, in which the P content is less than 60 ppm.

14. A nickel-base alloy as claimed in claim 1, in which the P content is less than 20 ppm.

15. A nickel base alloy according to claim 1, wherein the total of Mo and W is less than 4 at %.

16. A nickel base alloy according to claim 1, wherein the total of Mo and W is between 2 and 3 at %.

17. A nickel-base alloy according to claim 1, wherein the Ti:Ta atomic ratio is at least than 2:1.

18. A nickel base alloy according to claim 1, wherein the Cr content is between 15 and 16 at %.

* * * * *